US005319285A

United States Patent [19]

Wang et al.

[11] Patent Number: 5,319,285

[45] Date of Patent: Jun. 7, 1994

[54] STARTING CIRCUIT FOR A HIGH INTENSITY DISCHARGE LAMP

[75] Inventors: Da Y. Wang, Lexington; Brian Dale, Lynnfield; James R. McColl, Concord, all of Mass.

[73] Assignee: GTE Products Corporation, Danvers, Mass.

[21] Appl. No.: 919,423

[22] Filed: Jul. 23, 1992

[51] Int. Cl.[5] ..... H05B 37/00

[52] U.S. Cl. ..... 315/289; 315/DIG. 7; 315/290; 315/283; 315/208; 315/58; 315/72

[58] Field of Search ..... 315/283, 289, 290, 72, 315/71, 70, 58, 242, 243, 208, DIG. 7

[56] References Cited

U.S. PATENT DOCUMENTS 4,179,641 12/1979 Britton ..... 315/289

4,513,227 4/1985 Labadini et al. ..... 315/DIG. 7

*Primary Examiner*—James B. Mullins

*Assistant Examiner*—J. Dudek

*Attorney, Agent, or Firm*—Carlo S. Bessone

[57] ABSTRACT

A starting circuit is used in combination with a high intensity discharge lamp having electrodes. An inductor is in series with the electrodes of the lamp, and a first switching transistor is arranged in series with a diode and a load resistor. The first switching transistor, diode, and resistor are arranged in shunt with the electrodes of the lamp and in series with the inductor for charging the inductor when the first switching transistor is switched ON. The energy stored in the inductor is discharged as a voltage pulse across the lamp when the first switching transistor is switched OFF. A first bias circuit turns the first switching transistor ON at a first voltage level from an AC power source. A second switching transistor turns the first transistor OFF at a second voltage level. A second bias circuit turns the second switching transistor ON at the second voltage.

11 Claims, 4 Drawing Sheets

STARTING CIRCUIT FOR A HIGH INTENSITY DISCHARGE LAMP

FIELD OF INVENTION

This invention pertains to starting circuits for high intensity discharge lamps and, more particularly, is concerned with lamp starting circuits which may be used in proximity to or within high intensity discharge lamps.

BACKGROUND OF THE INVENTION

The ignition of a high intensity discharge (HID) lamp requires a voltage pulse across the electrodes of the lamp that is at least an order of magnitude higher than the normal operating line voltage. One conventional starting circuit for delivering such a voltage pulse includes a pulse transformer in combination with a capacitor and solid state components such as a sidac and transistor. Another conventional starting circuit uses non-linear capacitors (such as barium titanate) with sidacs.

It is desirable for the lamp starting circuit to operate in proximity to or within the lamp. However, for in-situ applications, only non-linear capacitors can be used since the pulse transformer and capacitor combinations are too large for this purpose. Although nonlinear barium titanate capacitor devices can fit inside an HID lamp, the device has a limited operating temperature range that makes the starting of most hot HID lamps impossible.

OBJECTS OF THE INVENTION

It is an object of the present invention to obviate the above noted and other disadvantages of the prior art.

It is an object of the present invention to provide an inexpensive circuit for HID lamp starting with a temperature range that is suitable for location within or in proximity to an HID lamp.

SUMMARY OF THE INVENTION

In accordance with a first aspect of the present invention, a circuit is provided for coupling energy from an AC source to a high-intensity discharge lamp having electrodes. An inductance means is coupled to the AC source, and a control circuit is coupled to the inductance means and the lamp. The control circuit is operable in response to a first voltage level signal from the AC source to permit a current flow through said inductance means. The control circuit is operable in response to a second voltage level signal from the AC source to interrupt the current flow through said inductance means.

According to a second aspect of the invention, there is provided a starting circuit in combination with a high intensity discharge lamp having electrodes forming a capacitor. An inductor is in series with the electrodes of the lamp for storing energy. A first switching transistor is arranged in series with a diode and a load resistor. The first switching transistor, diode, and resistor are arranged in shunt with the electrodes of the lamp and in series with the inductor for charging the inductor with inductive energy when the first switching transistor is ON, and for discharging the energy stored in the inductor as a voltage pulse across the lamp when the first switching transistor is turned OFF. A first bias circuit turns the first switching transistor ON at a first voltage. A second switching transistor turns the first transistor OFF at a second voltage. A second bias circuit turns the second switching transistor ON at the second voltage.

DETAILED DESCRIPTION OF THE PREFERRED EMBODIMENTS

The present invention relates to a lamp starting circuit including an inductive element for storing energy, and including a current interruption circuit for interrupting the current flow through the inductor whereby the inductor discharges the stored energy as a high voltage pulse across the lamp.

Figure 1:
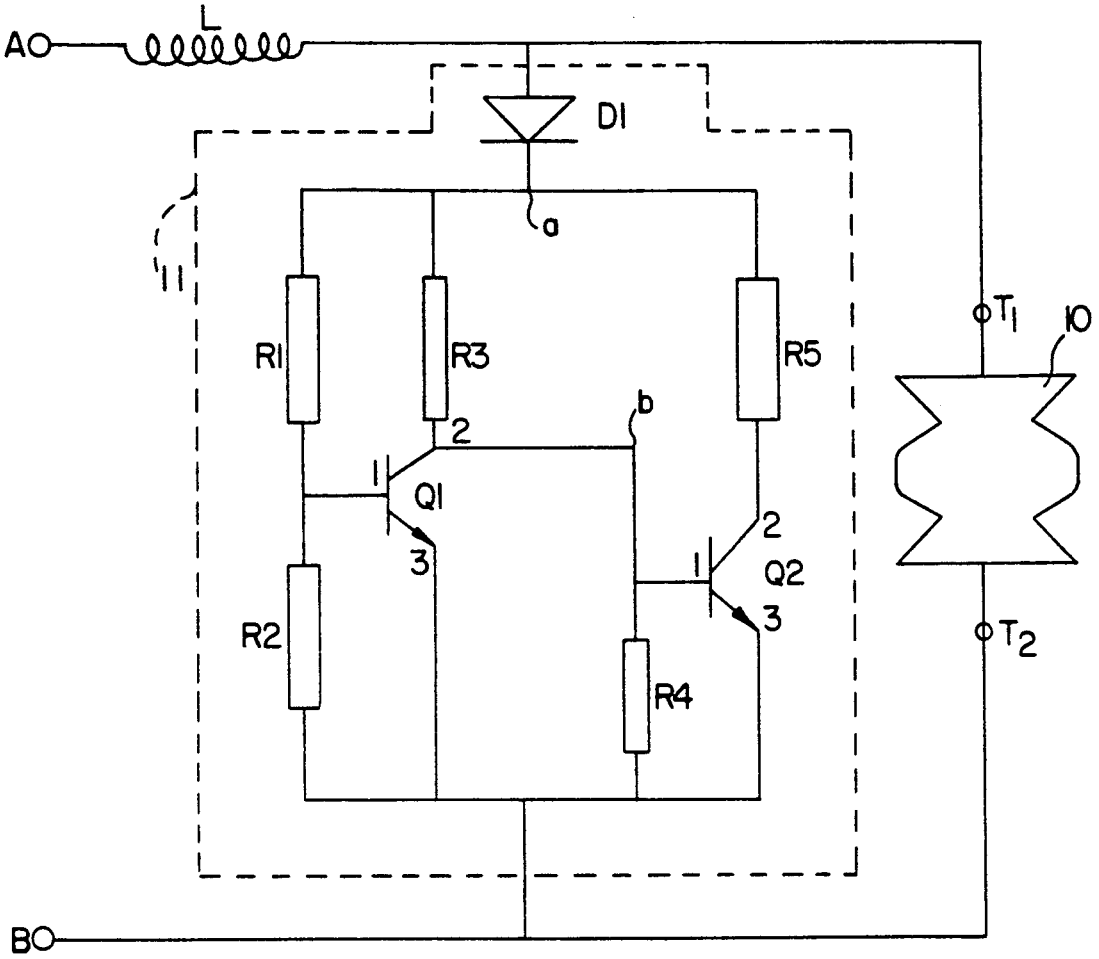
FIG. 1 is a starting circuit for a high intensity discharge lamp.

FIG. 1 is a schematic illustration of a starting circuit for an HID lamp 10 in accordance with the present invention. As known to those skilled in the art, the lamp 10 may be represented in the circuit as a capacitive component with capacitance C. The circuit includes an inductive element L and control circuit 11, and is powered by an AC line voltage $V_{AB}$ which develops across terminals A–B. In conventional starting circuits, this line voltage $V_{AB}$ is applied across the terminals $T_1$–$T_2$ of lamp 10 in a ballast configuration for limiting the lamp current, while in the present invention the inductor L and control circuit 11 process the AC line voltage so that it becomes a pulse across the lamp terminals $T_1$–$T_2$.

Control circuit 11 initially operates in a charge mode to permit current to pass through inductor L and thereby store energy in the inductor, and then operates in an interrupt mode to cease the flow of current and thereby cause the inductor to discharge the stored energy. The control circuit 11 includes a diode D1 which rectifies the lamp voltage $V_{AB}$ and provides unidirectional current flow to either charging circuitry or interrupt circuitry. The charging circuitry includes a load resistor R5 and a first switching transistor Q2 operably biased by impedance elements R3 and R4 to be switched into an ON state at a first voltage level. The interrupt circuitry includes a second switching transistor Q1 operably biased by impedance elements R1 and R2 to be switched into an ON state at a second voltage level. Control circuit 11 is designed so that when Q2 is ON, Q1 is OFF, and vice-versa.

Transistor Q2 is arranged in series with diode D1 and impedance R5 so that when transistor Q2 is operable in an ON state, inductor L is being charged with inductive energy as current flows through the current path formed by the serially-connected components L, D1, R5, and Q2. As noted above, Q1 is OFF during the period when Q2 is ON. The diode D1, transistor Q2, and impedance R5 are arranged in shunt with the electrodes of the lamp. As will be detailed below, the energy stored in the inductor L is discharged across the lamp electrodes as a voltage pulse of magnitude V when the first switching transistor Q2 is switched OFF under the control of transistor Q1 as Q1 is switched ON. The specific operation of the circuit in FIG. 1 is presented below with reference to FIG. 2.

Figure 2:
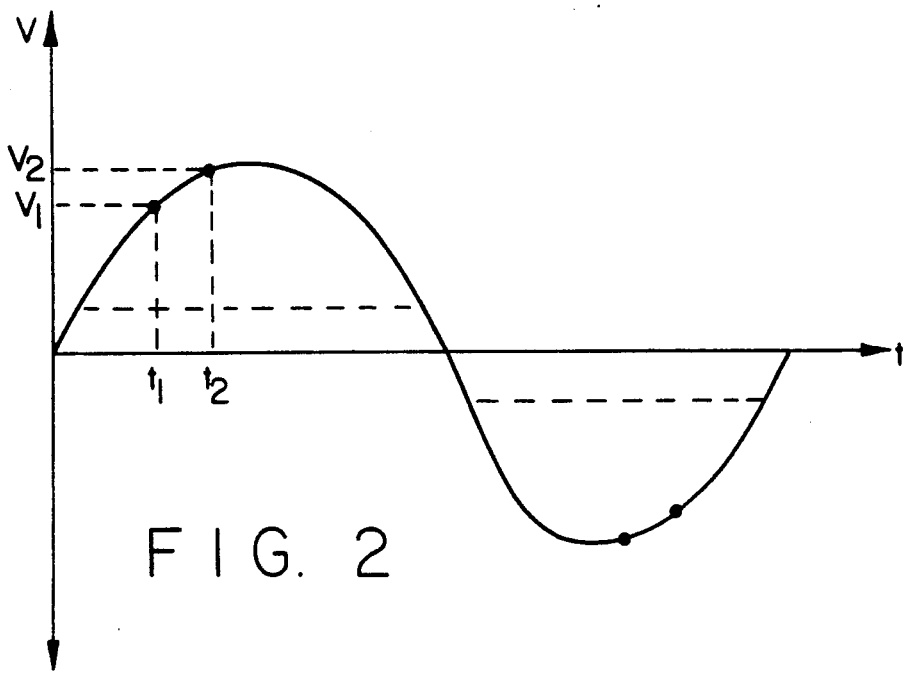
FIG. 2 illustrates voltage relationships in the starting circuit.

The impedance values of bias resistors R1, R2, R3, and R4 are appropriately selected so that transistor Q2 will switch ON before transistor Q1. As shown in FIG. 2, transistor Q2 is switched into an ON state at a first AC line voltage level $V_1$ at time $t_1$, while transistor Q1 is switched into an On state at a second AC line voltage level $V_2$ at time $t_2$.

Transistor Q2 is appropriately biased by resistors R3 and R4 so that at the first voltage level $V_1$, the voltage across R4 reaches the threshold voltage of Q2 and causes Q2 to switch into an ON state. Consequently, a current path is formed through inductor L and impedance R5 so that inductor L can be charged through load resistor R5. Specifically, from time $t_1$ corresponding to the first AC line voltage level $V_1$, the current flowing through load impedance R5 increases in value from zero at $t_1$ to I at $t_2$. Accordingly, the energy stored in inductor L has a magnitude of $\frac{1}{2}$ *$LI^2$.

The control circuit 11 functions as explained below to develop a voltage pulse of magnitude V across terminals $T_1$-$T_2$ by transferring the energy stored in the inductance L to the lamp. The energy transfer occurs by switching OFF transistor Q2 at a second AC line voltage level through the control of transistor Q1 in the interruption circuitry.

Transistor Q1 is biased by resistors R1 and R2 so that at the second AC line voltage level $V_2$ the voltage across R2 reaches its threshold voltage, thereby switching Q1 into an ON state. However, once Q2 is switched ON, the voltage across R4 is reduced below a cutoff condition whereby transistor Q2 is switched OFF. Once the current path is broken through load resistor R5 as Q2 is switched OFF, inductor L is no longer being charged and the stored energy is therefore discharged. The time period ($t_2$-$t_1$) is the duration between the time that Q2 is switched ON and then switched OFF as transistor Q1 is switched ON. It is desirable to keep the time when Q2 is ON as narrow as possible so that the total energy loss through load resistor R5 is kept at a minimum, although this time must be adequate for sufficient current to flow through the inductor L so that enough energy is stored in the inductor to provide the necessary voltage pulse across the lamp.

As known to those skilled in the art, the voltage across an inductor is defined by the relationship $V_L=L[di_L/dt]$, where $[di_L/dt]$ is the rate of change of current flowing through the inductor. Accordingly, when this current flow is interrupted once Q2 is switched OFF, a voltage pulse proportional to the rate of change of current develops across the inductor and is applied to the lamp. If the pulse is sufficient to start the lamp, the inductor will be discharged. Otherwise, the energy will oscillate between the inductor and circuit capacitance, and will gradually dissipate.

The amplitude V of the pulse can be found from the following equation:

$$CV^2=ALI^2$$

where A is a constant which is positive with a value smaller than 1.0, and C is the capacitance of the lamp. Its actual value is determined by the energy-loss mechanism of the whole circuitry, particularly that of resistor R5, and is a measure of how efficiently the energy stored in the inductor L is transferred to the capacitor C. If the lamp is ignited by pulse V, the lamp voltage drops to a value such that the voltage appearing at the base of Q2 is below the trigger point of first switching transistor Q2, preventing power loss.

Although Q1 and Q2 are shown as bipolar junction transistors in FIG. 1, this should not serve as a limitation of the present invention. In particular, Q1 and Q2 may also be MOSFET transistors.

As described above in connection with FIG. 1, the starting circuitry uses a single transistor Q2 in the charging circuitry for charging inductor L, and uses a single transistor Q1 in the interruption circuitry for switching Q1 ON and thereby switching Q2 OFF to cause discharge from inductor L. However, in order to sustain a high voltage pulse across the lamp, a plurality of serially-connected transistors Q2 may be necessary. Alternative circuit configurations for making such a modification to the circuit in FIG. 1 are presented in FIGS. 3*a*-*b*.

Figure 3B:
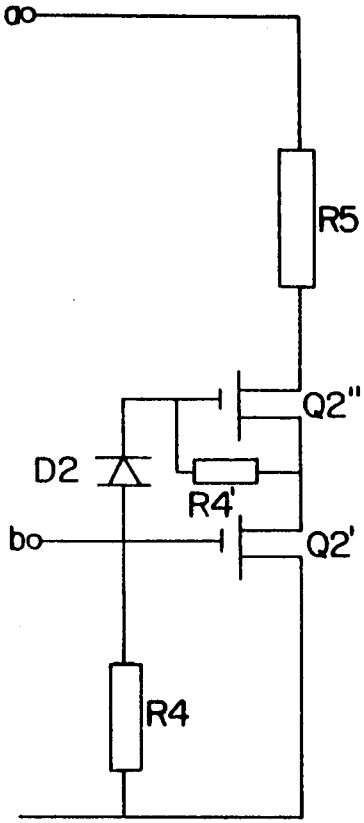
FIGS. 3*a*, 3*b*, 4*a*, 4*b*, 5 and 6 are schematic representations of variations of the starting circuit of FIG. 1.
Figure 3A:
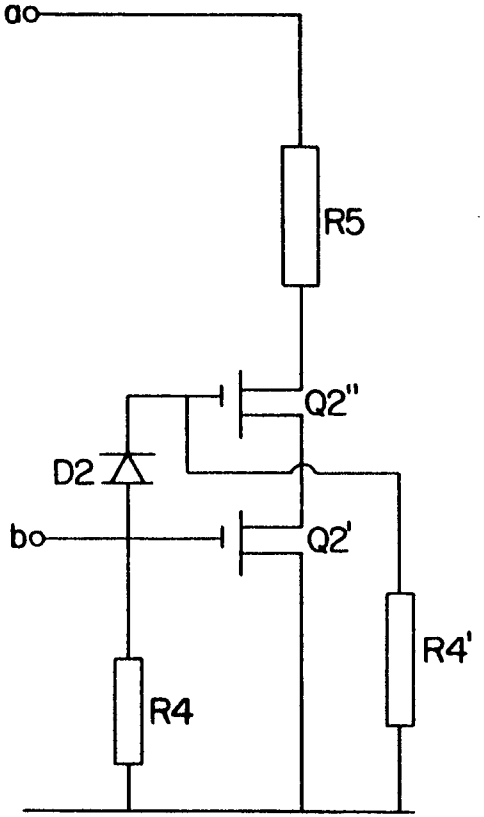

As shown in FIGS. 3*a*-*b*, transistor Q2 in FIG. 1 has been replaced by serially-connected transistors Q2' and Q2''. The circuit also includes a diode D2 and resistor R4' to ensure that transistors Q2' and Q2'' are switched OFF simultaneously. Terminals a-b refer to connection points in the circuit of FIG. 1.

Figure 4A:
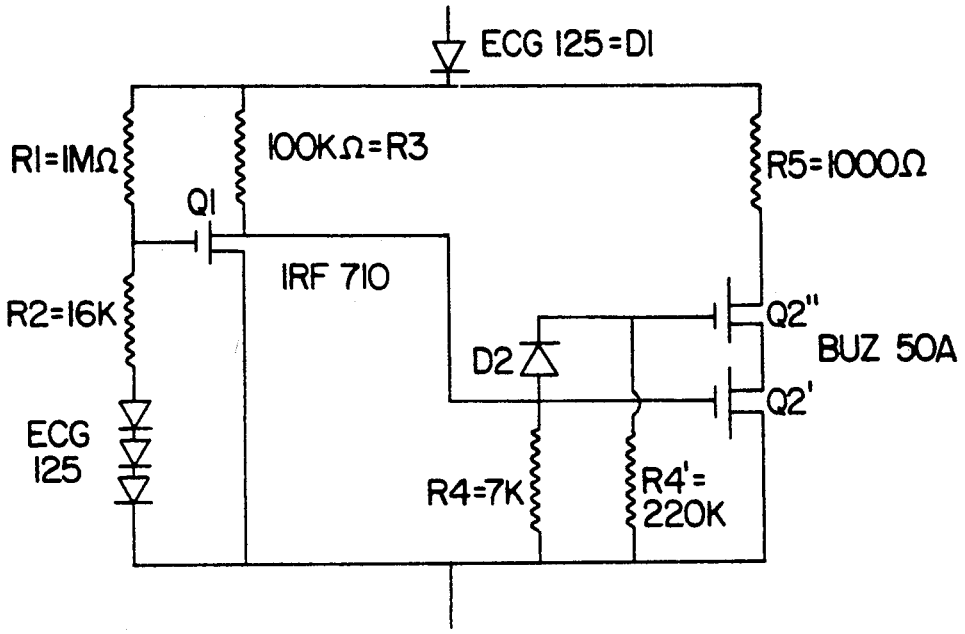
Figure 4B:
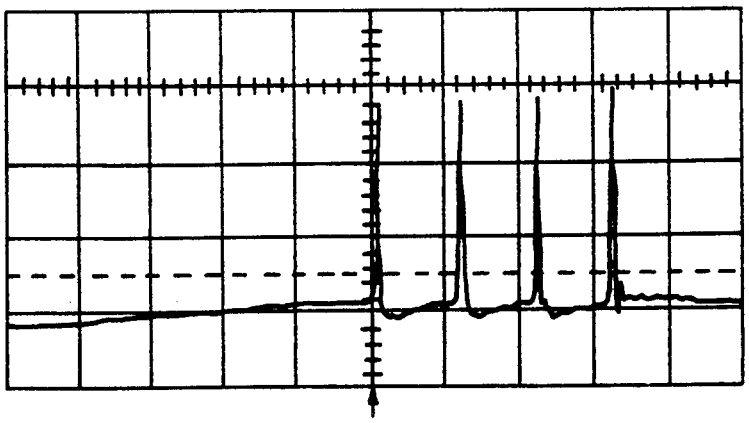

A starting circuit according to FIG. 3*a* was built and tested for starting a 70W high pressure sodium lamp between a working temperature range of −55° C. to 210° C., and is shown in FIG. 4*a* with accompanying waveform trace (FIG. 4*b*) of 1538V pulse outputs. The line voltage is 110 VAC, and inductor L has a value of 0.1 H. The circuit is capable of generating 1500–2000V pulses across a lamp with other component values readily determinable by one skilled in the art.

It was observed in the circuit of FIG. 1 that as the temperature of the circuit increases, the threshold voltages of transistors Q1 and Q2 decrease, causing a shift to lower values of the trigger points represented by line voltages $V_1$ and $V_2$ in FIG. 2. This shift to lower voltage levels reduces the energy stored in the inductor L and therefore reduces the magnitude V of the pulse delivered to the lamp. This temperature effect, however, can be compensated by the inclusion of diodes in series with resistor R2. The diode voltage of such compensation diodes is reduced at elevated temperatures, thereby offsetting the threshold voltage reduction and making the current in resistor R2 which is necessary to switch transistor Q1 ON (and thus switch Q2 OFF) almost independent of temperature.

Figure 5:
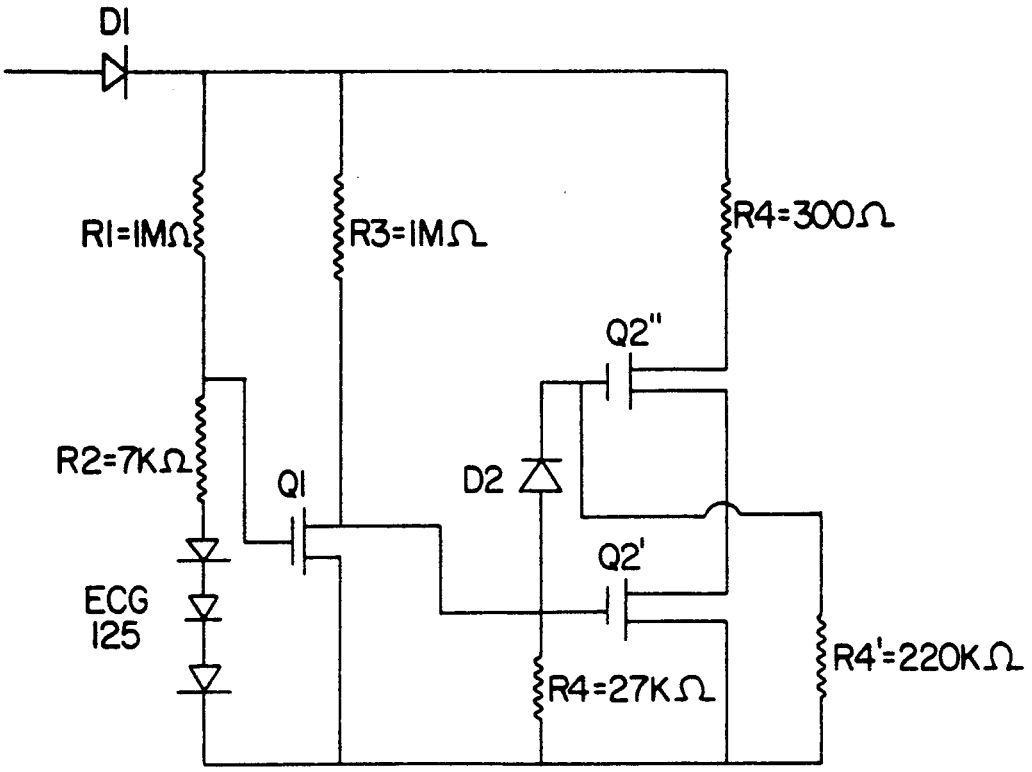

FIG. 5 illustrates a circuit according to FIG. 3*a* which includes diodes in series with R2 to compensate for the reduction in transistor threshold voltage. In the example shown in FIG. 5, the circuit starts a 1OOW Metal Halide lamp. The AC voltage across the lamp before it starts is ±400V. Inductor L has an inductance 0.45H and has a stray capacitance of 1 nF. A capacitor is in parallel with inductor L. The same approach can be used with first switching transistor Q2 to compensate for any temperature-induced reduction in threshold voltage, wherein extra diodes are added to resistor R4 so that the trigger point of first switching transistor Q2 becomes independent of temperature.

The starting circuitry of the present invention may be utilized with other electro-mechanical devices or thermal-mechanical devices for lamp-starting or lamp-protection applications. With such devices, transistors Q1 and Q2 may be used in tandem (as in FIG. 1) or individually to provide circuitry for either charging the inductor or interrupting the current. The advantages of using these devices is that better control of the trigger point is possible compared to traditional components such as sidacs and glow bottles.

Figure 6:
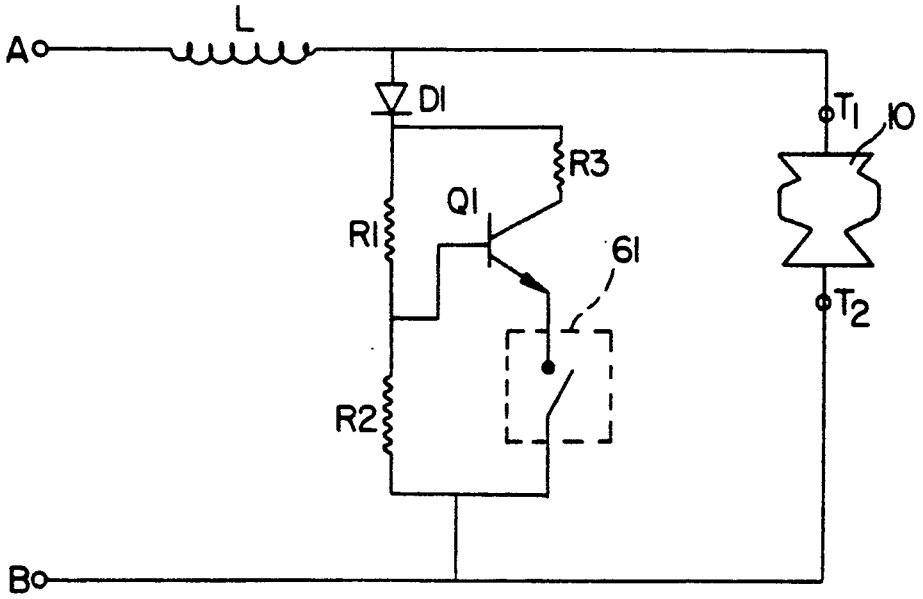

FIG. 6 schematically illustrates an embodiment of the present invention wherein the charging circuitry of FIG. 1 associated with transistor Q2 is implemented with a bi-metal switch 61. As known to those skilled in the art, a component such as switch 61 operates naturally in a closed state. In the schematic of FIG. 6, inductor L is charged during the period when Q1 is ON and switch 61 is closed. However, at the occurrence of a thermal condition in switch 61, the switch opens and current is interrupted through inductor L. The energy currently stored in inductor L is then discharged as a voltage pulse.

The specific component values indicated in FIGS. 3–6 are shown for exemplary purposes only, and should not serve as a limitation of the present invention. It should therefore be obvious to those skilled in the art that the charging and interruption circuits of the present invention may include components with other suitable values.

The starting circuit of the present invention is suitable for in-situ applications because of the commercial availability of packaging materials which enable the circuit to be inserted inside the lamp while withstanding the high temperature environment of the lamp.

In applications where the circuit may be placed either inside or outside the lamp, an additional component such as a Positive-Temperature-Coefficient Resistor (PTCR) or a bi-metal switch can be added in series with the resistor R5 to protect the circuit in case the lamp cannot be started. Alternatively, a PTCR material can be used for resistor R5. Examples of such packaging materials include ceramics and composite plastics.

While there has been shown and described what are at present considered the preferred embodiments of the invention, it will be obvious to those skilled in the art that various changes and modifications can be made therein without departing from the scope of the invention as defined by the appended claims.

What is claimed is:

1. A circuit for coupling energy from an AC source to a high intensity discharge lamp having electrodes, comprising:
- an inductor in series with said source and lamp;
- a control circuit coupled between said inductor and lamp at a common point;
- said control circuit comprising
  - a diode connected at a first terminal to said common point;
  - a load resistor and first transistor circuit connected in series between a second terminal of said diode and ground, wherein said first transistor circuit is biased for ON operation at a first signal voltage level of said source to provide a current path through said load resistor for charging said inductor; and
  - a second transistor circuit connected between the second terminal of said diode and ground and operatively coupled to said first transistor circuit, wherein said second transistor circuit is biased for ON operation at a second signal voltage level to force said first transistor circuit into an OFF operation.

2. The circuit as recited in claim 1 wherein said first transistor circuit comprises:
- a switching transistor having a first, second, and third terminal wherein said third terminal is coupled to ground;
- a first bias resistor coupled between the second terminal of said diode and the first terminal of said transistor; and
- a second bias resistor coupled between the first terminal of said transistor and ground.

3. The circuit as recited in claim 2 wherein said second transistor circuit comprises:
- a switching transistor having a first terminal, a second terminal coupled to the first terminal of the switching transistor in said first transistor circuit, and a third terminal coupled to ground;
- a first bias resistor coupled between the second terminal of said diode and the first terminal of the switching transistor in said second transistor circuit; and
- a second bias resistor coupled between the first terminal of the switching transistor in said second transistor circuit and ground.

4. The circuit as recited in claim 3 wherein
- the switching transistor of each of said first and second transistor circuit is a bipolar junction transistor, wherein the first terminal is a base connection, the second terminal is a collector connection, and the third terminal is an emitter connection.

5. The circuit as recited in claim 3 wherein
- the switching transistor of each of said first and second transistor circuit is a field effect transistor, wherein said first terminal is a gate connection, said second terminal is a drain connection, and said third terminal is a source connection.

6. A starting circuit in combination with a high intensity discharge lamp having electrodes forming a capacitor, comprising:
- an inductor in series with the electrodes of said lamp;
- a diode;
- a load resistor;
- a first switching transistor arranged in series with said load resistor and said diode, wherein said first switching transistor, said diode and said load resistor are arranged in shunt with the electrodes of said lamp and in series with said inductor for charging said inductor with inductive energy when said first switching transistor is ON, and for discharging the energy stored in said inductor as a voltage pulse across said lamp when said first switching transistor is OFF;
- a first bias circuit adapted to turn said first switching transistor ON at a first voltage;
- a second switching transistor adapted to turn said first transistor OFF at a second voltage; and
- a second bias circuit arranged to turn said second switching transistor ON at said second voltage.

7. The circuit as recited in claim 1 wherein said first transistor circuit comprises:
- a first and second transistor connected in series, and each having a first, second, and third terminal, wherein the second terminal of said first transistor is coupled to the third terminal of said second transistor;
- a first bias resistor coupled between the first terminal of said second transistor and ground;
- a second bias resistor coupled between the first terminal of said first transistor and ground;
- a third bias resistor coupled between the second terminal of said diode and the first terminal of said first transistor; and
- a bias diode coupled in a forward direction between the first terminal of said first transistor and the first terminal of said second transistor.

8. The circuit as recited in claim 7 wherein said first and second transistors are field effect transistors.

9. The circuit as recited in claim 1 wherein said first transistor circuit comprises:

a first and second transistor connected in series, and each having a first, second, and third terminal, wherein the second terminal of said first transistor is coupled to the third terminal of said second transistor at a circuit node;

a first bias register coupled between the first terminal of said second transistor and said circuit node;

a second bias resistor coupled between the first terminal of said first transistor and ground;

a third bias resistor coupled between the second terminal of said diode and the first terminal of said first transistor; and a bias diode coupled in a forward direction between the first terminal of said first transistor and the first terminal of said second transistor.

10. The circuit as recited in claim 8 wherein said first and second transistors are field effect transistors.

11. A circuit for coupling energy from an AC source to a high intensity discharge lamp having electrodes, comprising:

an inductor in series with said source and lamp;

a control circuit coupled between said inductor and lamp at a common point;

said control circuit comprising a diode connected at a first terminal to said common point;

a transistor having a first, second, and third terminal;

a thermal switch operating in a normally-closed state, and coupled between the third terminal of said transistor and ground;

a first resistor coupled between a second terminal of said diode and the first terminal of said transistor;

a second resistor coupled between the first terminal of said transistor and ground; and a third resistor coupled between the second terminal of said diode and the second terminal of said transistor.

* * * * *